United States Patent [19]

Keyes et al.

[11] 4,438,534

[45] Mar. 27, 1984

[54] PASSIVE DISPENSER

[75] Inventors: George B. Keyes; Randall G. Richards, both of Cincinnati, Ohio

[73] Assignee: The Drackett Company, Cincinnati, Ohio

[21] Appl. No.: 354,485

[22] Filed: Mar. 3, 1982

[51] Int. Cl.[3] ..... E03G 9/02

[52] U.S. Cl. ..... 4/227; 4/228

[58] Field of Search ..... 4/222–228

[56] References Cited

U.S. PATENT DOCUMENTS

| | | | |
|---|---|---|---|
| 252,556 | 1/1882 | Warren . | |
| 650,161 | 5/1900 | Williams et al. . | |
| 730,494 | 6/1903 | Venners | 4/228 |
| 969,729 | 9/1910 | Smith . | |
| 991,825 | 5/1911 | Bogie | 4/228 |
| 1,144,525 | 6/1915 | Blake . | |
| 1,175,032 | 3/1916 | Williams . | |
| 1,213,978 | 11/1916 | Thornton | 4/227 |
| 1,987,689 | 1/1935 | Lewis | 221/67 |
| 2,688,754 | 4/1954 | Willets et al. | 4/228 |
| 2,839,763 | 6/1958 | Newsom | 4/227 |
| 3,121,236 | 2/1964 | Yadro et al. | 4/228 |
| 3,339,801 | 9/1967 | Hronas | 4/228 X |
| 3,407,412 | 10/1968 | Spear | 4/228 |
| 3,423,182 | 1/1969 | Klasky | 4/228 X |
| 3,444,566 | 5/1969 | Spear | 4/228 |
| 3,504,384 | 4/1970 | Radley et al. | 4/228 |
| 3,521,306 | 7/1970 | Jacobs | 4/228 |
| 3,604,020 | 9/1971 | Moisa | 4/228 |
| 3,618,143 | 11/1971 | Hill et al. | 4/228 |
| 3,715,765 | 2/1973 | Yadro | 4/228 |
| 3,769,640 | 11/1973 | Castronovo | 4/228 |
| 3,772,715 | 11/1973 | Nigro | 4/228 |
| 3,778,849 | 12/1973 | Foley | 4/228 |
| 3,781,926 | 1/1974 | Levey | 4/228 |
| 3,864,763 | 2/1975 | Spransy | 4/227 |
| 3,867,101 | 2/1975 | Herring | 4/228 X |
| 3,934,279 | 1/1976 | Mallin | 4/228 |
| 3,943,582 | 3/1976 | Daeninckx et al. | 4/227 |
| 3,952,339 | 4/1976 | Baur et al. | 4/228 |
| 3,965,497 | 6/1976 | Corsette | 4/227 |
| 4,064,572 | 12/1977 | Wicks et al. | 4/227 |
| 4,171,546 | 10/1979 | Dirksing | 4/227 |
| 4,186,856 | 2/1980 | Dirksing | 4/228 X |
| 4,208,747 | 6/1980 | Dirksing | 4/228 |
| 4,216,027 | 8/1980 | Wages | 4/228 X |
| 4,244,062 | 1/1981 | Corsette | 4/228 |
| 4,251,012 | 2/1981 | Owens et al. | 4/227 X |
| 4,281,421 | 8/1981 | Nyquist et al. | 4/228 |
| 4,305,162 | 12/1981 | Cornelisse, Jr. et al. | 4/228 |
| 4,307,474 | 12/1981 | Choy | 4/228 |

FOREIGN PATENT DOCUMENTS

| | | | |
|---|---|---|---|
| 2916247 | 10/1980 | Fed. Rep. of Germany . | |
| 91804 | 11/1921 | Switzerland . | |
| 11469 | of 1890 | United Kingdom | 4/228 |
| 28813 | of 1905 | United Kingdom . | |
| 379553 | 9/1932 | United Kingdom . | |
| 705904 | 3/1954 | United Kingdom . | |
| 916652 | 1/1963 | United Kingdom . | |
| 1081032 | 8/1967 | United Kingdom . | |

*Primary Examiner*—Stephen Marcus
*Assistant Examiner*—Kenneth S. Putnam
*Attorney, Agent, or Firm*—Charles J. Zeller; George A. Mentis

[57] ABSTRACT

A passive dispenser for codispensing a predetermined volume of a first and a second solution into a body of liquid in response to a decrease in the level of said body of liquid comprising a first product chamber having a vent conduit and a refill/discharge pathway, and a second product chamber serially connected to a third product chamber thereabove by means of a conduit entering the second product chamber proximate the bottom thereof, said second and third product chambers having respective vent conduits and said second product chamber having a refill/discharge pathway, said pathways being siphon conduits.

7 Claims, 8 Drawing Figures

FIG. 6
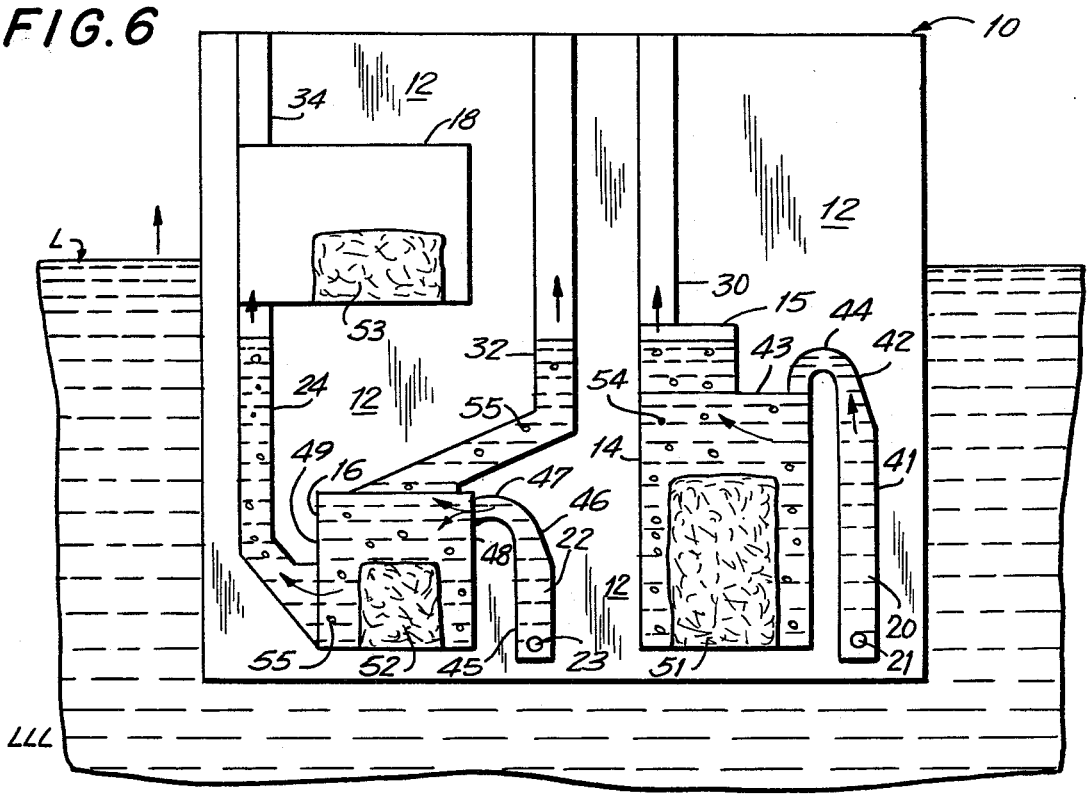
FIG. 7
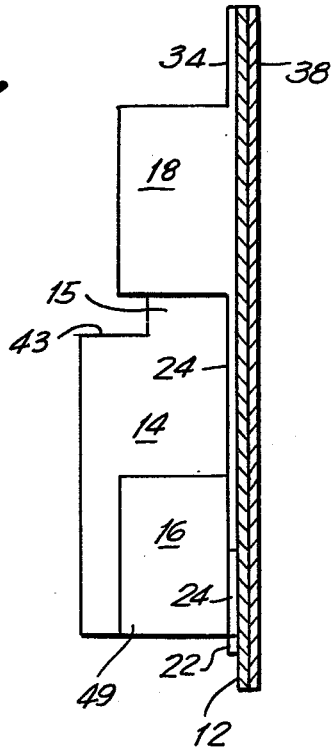
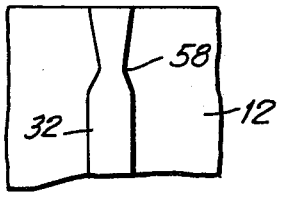
FIG. 8

PASSIVE DISPENSER

FIELD OF INVENTION

The present invention relates to a dosage dispenser for such products as toilet tank additives, e.g. disinfectants, detergents, dyes and the like. More particularly, the present invention relates to a dispenser which comprises no moving parts.

BACKGROUND OF INVENTION

Many dispensers with no moving parts, e.g. "passive" dispensers, are known, for example, U.S. Pat. Nos. 650,161 to Williams et al; 1,175,032 to Williams; 3,504,384 to Radley et al; 4,171,546, 4,186,856 and 4,208,747 to Dirksing; 4,216,027 to Wages; 4,251,012 to Owens et al; 4,281,421 to Nyquist et al; 4,305,162 to Cornelisse, Jr. et al, and 4,307,474 to Choy.

BRIEF DESCRIPTION OF DRAWINGS

FIGS. 2 to 6 are rear views of the dispenser of the present invention with backing substrate omitted, thereby providing a sequential representation of a discharge/refill cycle.

FIG. 7 is a cross-sectional view of the dispenser of FIG. 1 across section 7—7 of FIG. 1.

FIG. 8 is an embodiment of the vent designated as vent 32 adapted to receive means for suspending the dispenser.

DETAILED DESCRIPTION OF INVENTION

Figure 1:
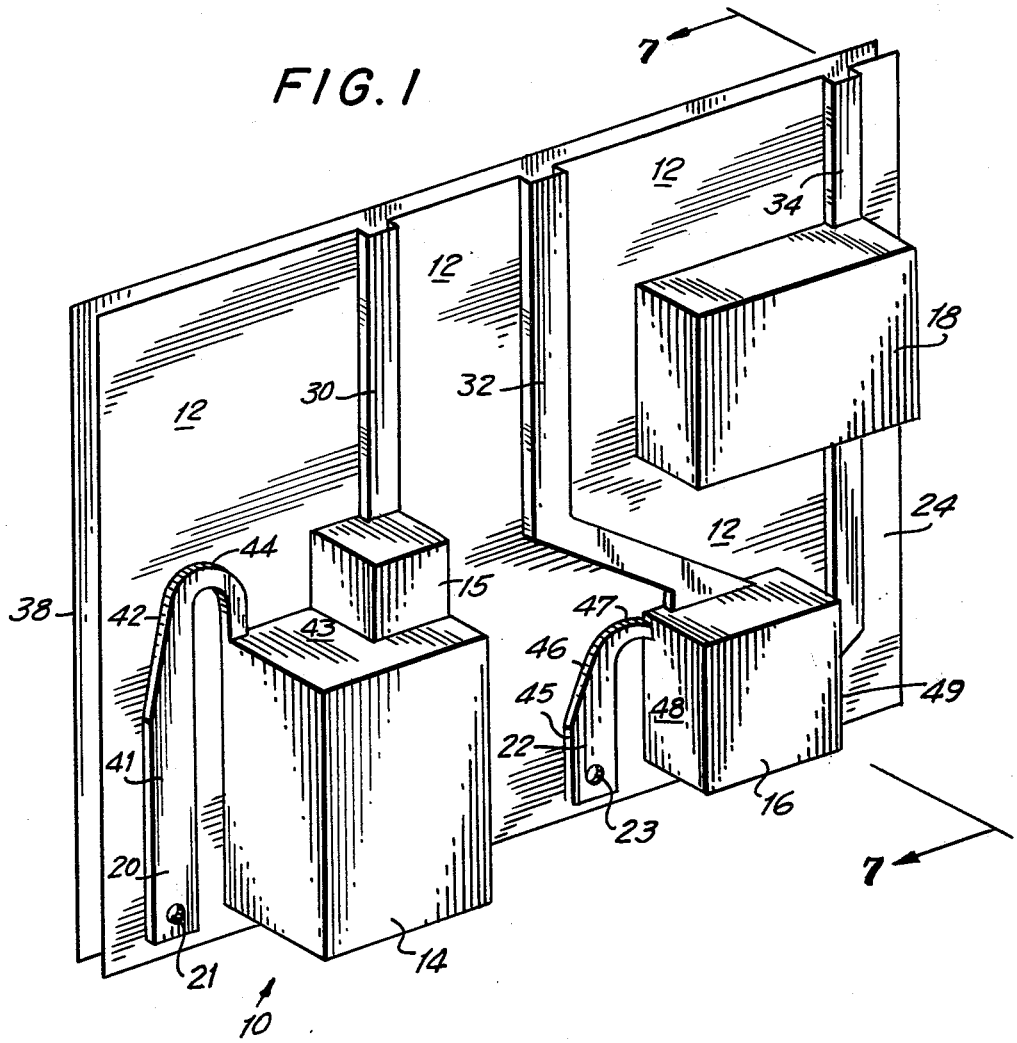
FIG. 1 is an exploded perspective view of the dispenser of the present invention.

Referring to FIG. 1 the dispenser 10 of the present invention comprises a first plastic substrate 12 molded in such fashion as to provide in unitary fabrication a first product chamber 14, a second product chamber 16, a third product chamber 18, a first refill/discharge pathway 20, a second refill/discharge pathway 22, a conduit 24 interconnecting the second and third product chambers 16 and 18, respectively, a first vent 30, a second vent 32, and a third vent 34 and a second plastic planar substrate 38 (shown more clearly in FIG. 7), said second substrate 38 being superposed over the back of the first substrate 12 and sealed thereto.

Product chamber 14 is separate and apart from the product chambers 16, 18, while the product chambers 16, 18 operate as a single dispensing chamber as is described below in greater detail. When assembled with substrate 12 sealed to substrate 38, the dispenser also comprises the materials to be dispensed from the dispenser, and means to suspend the dispenser from a tank, for example, a toilet tank, where by the materials within the dispenser are dispensed as solutions in response to a change in height of the tank water. The dispenser of the present invention has no moving parts, for example valves, to regulate the dispensation of solution therefrom, and hence is referred to as a passive dispenser.

As shown in FIG. 1, the product chamber 14 is provided with a product solution reservoir 15 which is located at the top of said chamber 14. Vent 30 extends from the top of the reservoir 15 to the top edge of substrate 12, and vents said reservoir (and chamber) to the atmosphere. Refill/discharge pathway 20 comprises a vertical section 41 having a divergent top portion 42, said vertical section 41 being connected to the top of the shoulder 43 of the chamber 14 by means of a gooseneck, or inverted U, member 44. Proximate the bottom end of vertical section 41, which is otherwise sealed, is an inlet/outlet orifice 21 through which liquid enters and leaves the chamber 14.

Chamber 16, located below chamber 18, is provided with refill/discharge pathway 22 having a vertical section 45, a divergent portion 46 of the vertical section 45, and a gooseneck 47 connecting the vertical section 45 to a sidewall, here sidewall 48, of the chamber 16. Vertical section 45 is provided proximate to its bottom end, which end is otherwise sealed, with an inlet/outlet orifice 23. The chamber 16 is vented to the atmosphere through vent 32, which is routed around the upper chamber 18.

Chamber 18 is connected to chamber 16 by means of conduit 24, which enters the chamber 16 proximate to the bottom of the chamber and on the wall 49, which wall is directly opposite wall 48. The conduit 24 enters the chamber 18 along its bottom wall, preferably proximate to a side wall thereof. Vent 34 proceeds from the top of the chamber 18 to the perimeter of substrate 12.

The substrates 12, 38 are fabricated preferably from a thermoplastic material, for example polyvinyl chloride, polyethylene, polystyrene, cellulosic resin, and acrylic resin, by thermoforming processes well known in the art. Without the backing substrate 38, the aforesaid product chambers, vents, etc., are accessible from the rear of the substrate 12, said substrate 12 being analogous in construction to a "blister pak" package. After filling the product chambers with the material to be dispensed (in solid form as here-inafter described), the two substrates are most easily joined by heat sealing or radio frequency sealing methods, although other appropriate bonding methods, for example a suitable adhesive, may be used.

FIGS. 2 to 6 show the dispenser 10 from the rear and with the backing substrate 40 removed. In so doing the interior of the dispenser may be viewed as in cross section, the FIGS. 2 to 6 illustrating sequentially a discharge and refill cycle. The tank into which dispensing occurs is not shown, only the water in the tank being depicted.

Material to be dispensed, represented by solid bars or cakes 51, 52, 53, are disposed in product chambers 14, 16 and 18, respectively, the cake 51 containing as an active constituent at least one compound selected from the group consisting of dyes, detergents and fragrances and mixtures thereof, while the cakes 52, 53 contain as an active constituent a disinfectant halogen releasing agent, preferably a halogen releasing agent of low solubility. The materials to be dispensed may also exist in forms other than a bar or cake, for example, as a gel or semisolid as a coating or impregnate within a suitable carrier, or as a pulverulent material within a water permeable membrane.

The detergent is preferably an anionic surfactant, non-ionic surfactant or mixture of same, for example an $\alpha$-olefin sulfonate (Siponate 301-10F manufactured by Alcolac, Inc.), an alkyloxy poly (ethyleneoxy) alcohol, e.g., tridecyloxypoly (ethyleneoxy) ethanol sold under the trademark Emulphogene TB-920 by GAF Corp., or a polyoxypropylene polyoxyethylene copolymer condensate such as Pluronic F-127 sold by Wyandotte Industrial Chemicals, Inc.

The dye is preferably stable to attack by the halogen releasing agent. A number of such dyes have been identified in U.S. Pat. Nos. 4,249,274 and 4,308,625 to Kitko, incorporated herein by reference thereto, for example FD&C Blue #1 (C.I. 42090), FD&C Blue #2 (C.I. 73015), and FD&C Green #3 (C.I. 42053). Many fragrances well known to the art may be incorporated, for example Fragrance #46174H sold by Haarmann and Reimer Corp.

The preferred disinfectant is an N-halogentated organic compound, for example 1-bromo-3-chloro-5,5-dimethyl hydantoin (BCDMH). Most preferred are the N-halogenated compounds referred to in Patterson, U.S. Pat. No. 3,412,021, which compounds are in agglomerate form and have a solubility in water of from about 0.0001 to about 1% by weight at 20° C. The Patterson patent is incorporated herein by reference thereto. The BCDMH in agglomerated form has a solubility of about 0.15% by weight at 77° F.

Figure 2:
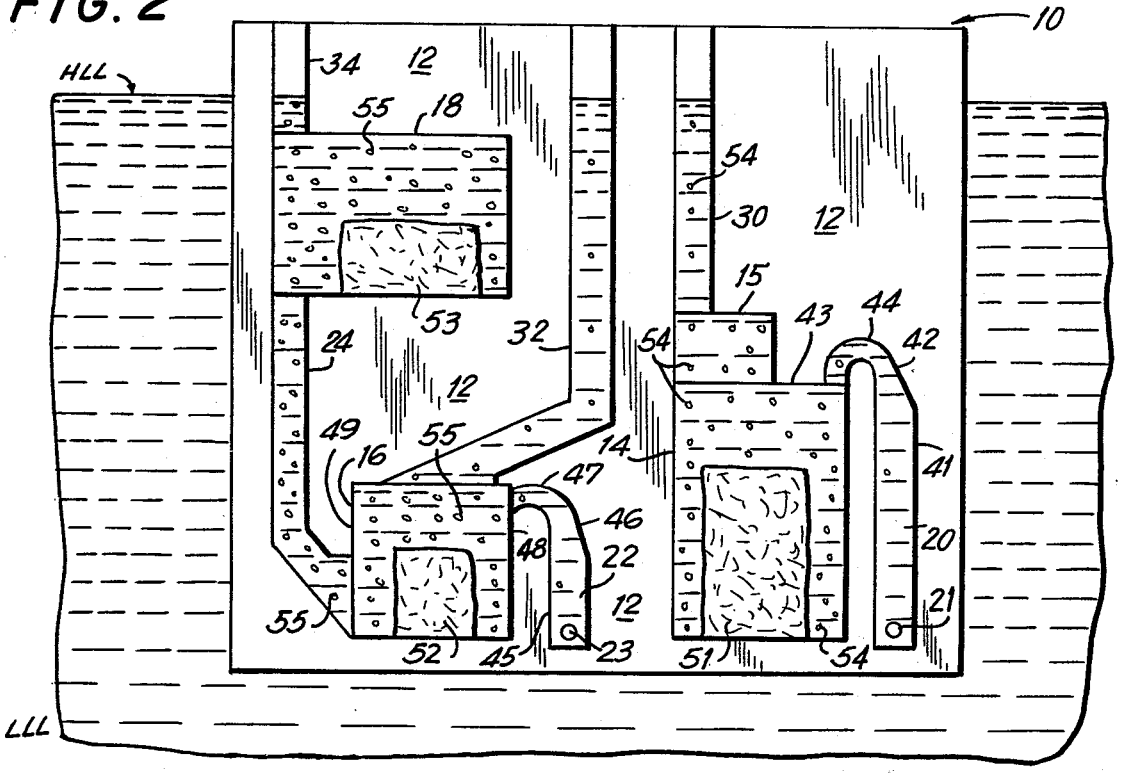

In FIG. 2 the dispenser 10 is within a filled toilet tank (not shown), the water being quiescent within the tank at the high liquid level HLL (i.e., between flushes). Each product chamber 14, 16, and 18 is vented to the atmosphere through respective vents 30, 32 and 34. Over time, the materials to be dispensed comprising or contained in the bars 51, 52 and 53 go into solution, which solution is usually at equilibrium concentration. The chambers are not isolated from the tank water by valves or other active means. Nor are the chambers isolated by means of an air lock. Hence, migration of solute from chambers 14 and 16 (and from 18 through 16) may occur by diffusion. While high rates of migration would result in reduction of dispenser life, the rate of diffusion is quite low. As shown with respect to chamber 14, the gooseneck, here gooseneck 44, can enter at the top of the chamber establishing a gravimetric restraint to diffusion, which can yet occur. Where the material to be dispensed is of relatively moderate solubility, as in the case of the dye or detergent, the restraint to diffusion obtained by gooseneck 44 is advantageous.

Because the halogenated disinfectant contained in chambers 16 and 18 has a low solubility, the gooseneck 47 can enter the sidewall 48. Furthermore, in the case of BCDMH, the preferred disinfectant, the solution 55 develops a density gradient within the chamber 16, which gradient provides a natural deterrent against diffusion. Finally, solute which migrates from the dispenser is substantially diluted by the large volume of water residing in the tank.

Figure 3:
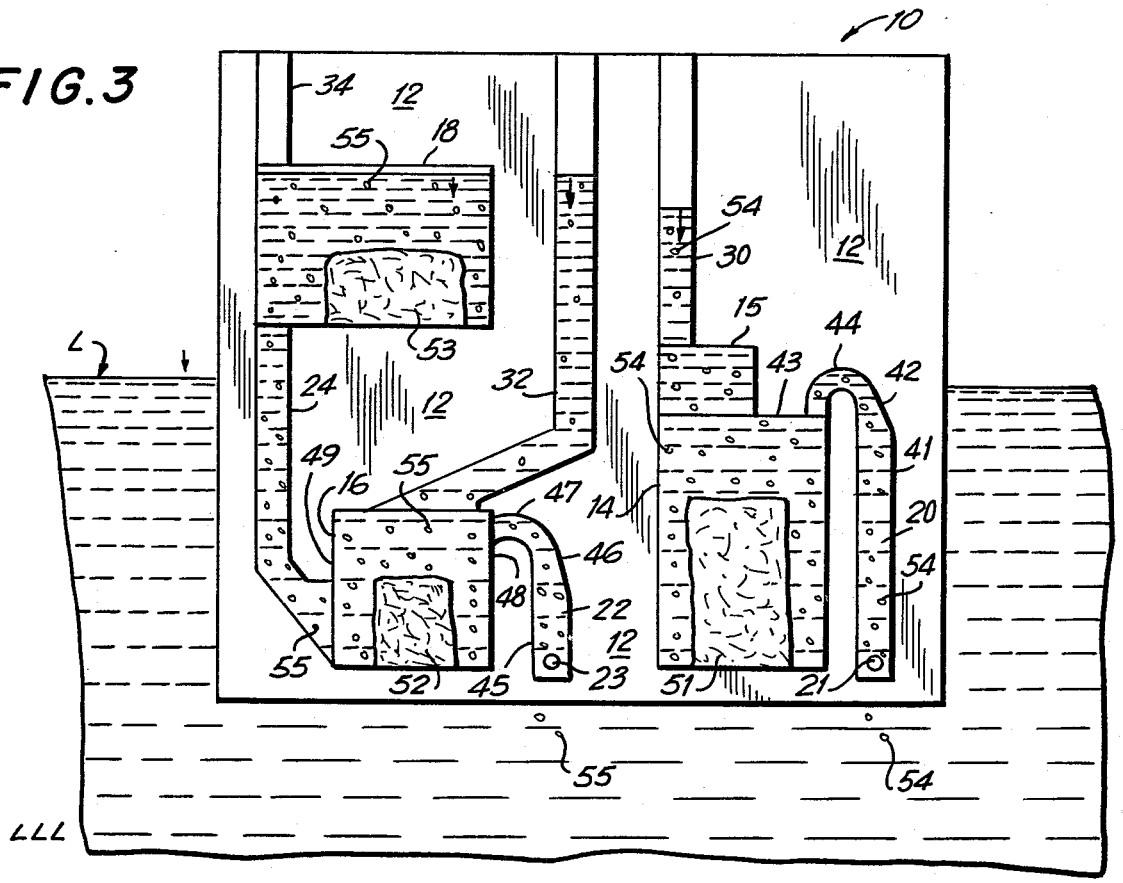

As shown in FIG. 3, upon a flush, the water level L in the tank drops rapidly, more rapidly than the decrease in solution 54 and 55 level in the respective product chambers and accompanying vents. The low flow rate from the dispenser 10 is occasioned by the provision of orifices 21 and 23, which require substantial head pressure to accelerate flow from the dispenser. Thus, the major portion of solution ultimately dispensed from the dispenser 10 is postponed until the tank water level L drops substantially to near the tank low liquid level LLL as illustrated in FIG. 4.

Figure 4:
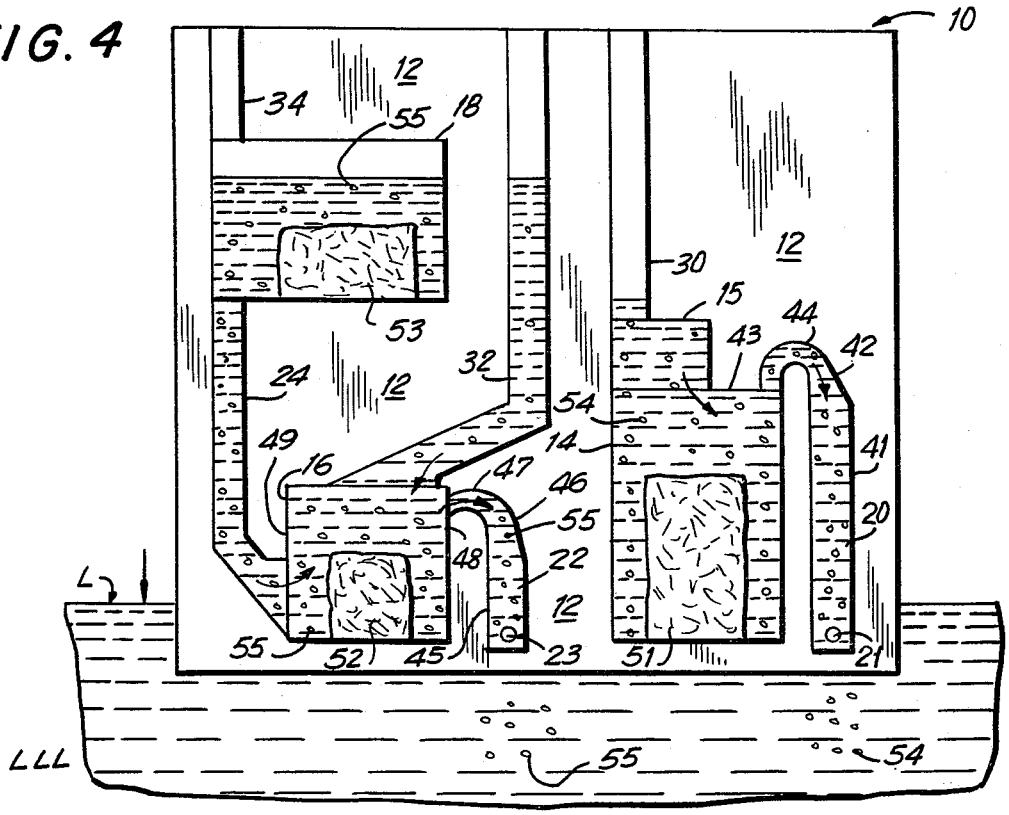
Figure 5:
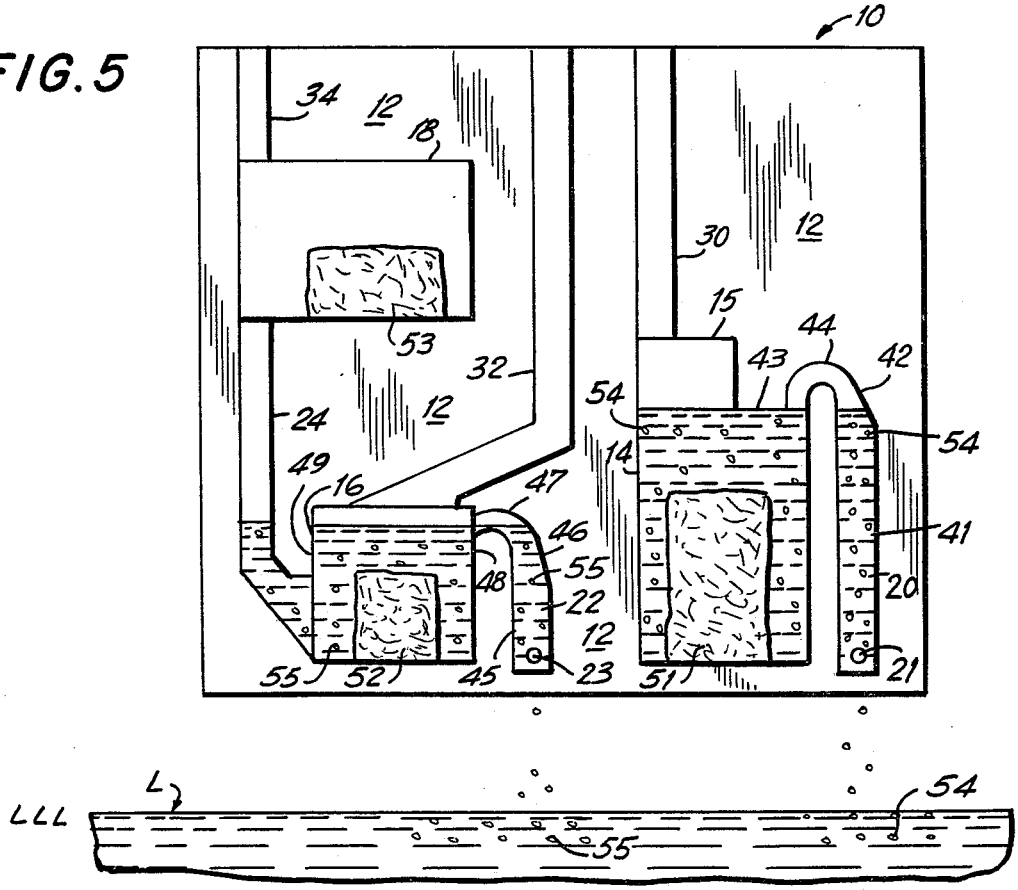

As observed by viewing FIGS. 4 and 5, during the time interval commencing when the tank level L is proximate to the low liquid level LLL (FIG. 4) and ending upon closure of the tank water outlet valve (FIG. 5) (which closing occurs a short time, e.g., say about 5 to 10 seconds, after the low liquid level is reached), essentially all remaining solution from the product chambers is released, thereby concentrating the cleaning and disinfecting action of the actives at the end of the flush.

As shown in FIG. 5, the amount of solution dispensed into the tank water from chamber 14 is equal to the volume of the product solution reservoir 15, which solution drains through the refill/discharge pathway 20 by means of a siphon effect created through gooseneck 44 and between the reservoir 15 and the tank.

Similarly, a siphon effect is achieved in chamber 16, the solution level therein ultimately being lowered until air from vent 32 enters the gooseneck. However, the large bulk of the disinfecting solution 55 is provided from chamber 18, which solution flows by gravity to chamber 16, and then to the tank. During the emptying of chamber 18, the solution 55 therefore flows from said chamber, through the conduit 24, into chamber 16, and past the solid bar 52. The flow past the bar 52 has been found to cause sufficient turbulence in chamber 16 as to increase dissolution of the bar 52, thereby effectively concentrating the disinfectant effluent solution actually dispensed into the toilet bowl.

In FIG. 6, the tank level L has risen, water also entering the chambers 14 and 16 through orifices 21 and 23. Upon reaching the high liquid level, the situation shown in FIG. 2 is again obtained.

FIG. 7 illustrates a cross-sectional view of the dispenser showing the disposition of both substrates 12 and 38. FIG. 8 illustrates an embodiment of vent 32 adapted to receive the hanging means (not shown) by means of swagged portion 58.

We claim:

1. A passive dispenser for containing a quantity of a first solution and a quantity of a second solution and for co-dispensing a predetermined volume of said solutions into a body of liquid in which said dispenser is placed, in response to the level of said body of liquid being lowered from a first elevation to a second elevation, the dispenser comprising:

a first product chamber, said product chamber containing a water-soluble cake forming, upon dissolution, the first solution;

a vent conduit extending upwardly from the top of the first chamber;

a first refill/discharge pathway providing fluid communication between said body of liquid and said first product chamber, said pathway being a siphon conduit;

a second product chamber, said second product chamber being separate and apart from said first product chamber;

a third product chamber above the second chamber, which chambers are separate and apart one from the other;

a water-soluble cake being contained in at least one of said second and third product chambers forming, upon dissolution, the second solution;

a conduit to provide fluid communication between the second chamber and the third chamber, said conduit entering the second chamber proximate the bottom thereof;

vent conduits extending upwardly from the respective tops of said second and third product chambers; and a second refill/discharge pathway providing fluid communication between said body of liquid and said second product chamber, said second refill/discharge pathway being a siphon conduit, whereby in response to the level of said body of liquid being lowered from a first elevation to a second elevation, solution contained within the second and the third chambers is dispensed into the body of liquid, and solution contained within the first chamber is dispensed into said body of liquid.

2. A passive dispenser for containing a quantity of a first solution and a quantity of a second solution and for co-dispensing a predetermined volume of said solutions into a body of liquid to which said dispenser is placed, in response to the level of said body of liquid being lowered from a first elevation to a second elevation, the dispenser comprising a first substrate, and a second substrate sealably joined to the back of the first substrate, said first substrate being thermoformed as to provide:

a first product chamber, said chamber containing a water-soluble cake forming, upon dissolution, the first solution;

a vent conduit extending upwardly from the top of the first chamber;

a first refill/discharge pathway providing fluid communication between said body of liquid and the first product chamber, said pathway being a siphon conduit;

a second product chamber, said second chamber being separate and apart from said first product chamber;

a third product chamber above the second chamber, a water-soluble cake being contained in at least one of said second and third product chambers forming, upon dissolution, the second solution, which chambers are separate and apart one from the other;

a conduit to provide fluid communication between the second chamber and the third chamber, said conduit entering the second chamber proximate the bottom thereof;

vent conduits extending from the respective tops of the second and third product chambers; and a second refill/discharge pathway providing fluid communication between said body of liquid and said second chamber, second pathway being a siphon conduit; whereby, in response to the level of said body of liquid being lowered from a first elevation to a second elevation, solution contained within the second and third chambers is dispensed into the body of liquid, and solution contained within the first chamber is dispensed into the body of liquid.

3. The dispenser of claim 1 or 2 wherein the siphon conduits comprise a vertical section, said section having a divergent portion proximate to the top thereof, and a gooseneck connected to the divergent portion and to the respective product chamber.

4. The dispenser of claim 3 wherein the siphon conduits are provided with an inlet/outlet orifice proximate the bottom of the vertical section, the siphon conduits being otherwise sealed off from the body of liquid.

5. The dispenser of claim 1 or 2 wherein the first product chamber is provided with a cake material containing as actives at least one constituent from the group comprising dye, detergent and fragrance, and wherein the second and third product chambers are provided with a cake material containing as an active a halogen releasing agent of low solubility.

6. The dispenser of claim 5 wherein the halogen releasing constituent is 1-bromo-3-chloro-5,5-dimethyl hydantoin in agglomerated form.

7. The dispenser of claim 1 or 2 further comprising hanging means, which hanging means are inserted into the vent from the second product chamber.

* * * * *